US008430627B2

(12) United States Patent
Ruiz et al.

(10) Patent No.: US 8,430,627 B2
(45) Date of Patent: Apr. 30, 2013

(54) GAS TURBINE EXHAUST STRUT REFURBISHMENT

(75) Inventors: Jose Luis Ruiz, Lake Worth, FL (US); Russell Bond Jones, Jupiter, FL (US); Robert Kevin Read, Toledo, OH (US); Alexander Ortega, Lake Worth, FL (US)

(73) Assignee: Alstom Technology Ltd, Baden (CH)

( * ) Notice: Subject to any disclaimer, the term of this patent is extended or adjusted under 35 U.S.C. 154(b) by 812 days.

(21) Appl. No.: 12/608,613

(22) Filed: Oct. 29, 2009

(65) Prior Publication Data

US 2011/0103947 A1 May 5, 2011

(51) Int. Cl.
*F01D 25/24* (2006.01)

(52) U.S. Cl.
USPC ..... 415/142; 415/211.2

(58) Field of Classification Search ..... 415/211.2, 415/142, 191; 29/889.71; 416/224
See application file for complete search history.

(56) References Cited

U.S. PATENT DOCUMENTS

| | | | | |
|---|---|---|---|---|
| 1,939,357 | A * | 12/1933 | Lorenzen | 416/224 |
| 4,919,593 | A | 4/1990 | Brown | |
| 4,993,918 | A * | 2/1991 | Myers et al. | 415/191 |
| 5,149,248 | A | 9/1992 | Cramer | |
| 5,494,405 | A | 2/1996 | Gray et al. | |
| 6,109,869 | A | 8/2000 | Maddaus et al. | |
| 2005/0042092 | A1 | 2/2005 | Boegli et al. | |
| 2006/0000077 | A1 | 1/2006 | Lundgren | |
| 2006/0010852 | A1 | 1/2006 | Gekht et al. | |
| 2007/0140845 | A1 | 6/2007 | Market et al. | |

* cited by examiner

*Primary Examiner* — Richard Edgar
(74) *Attorney, Agent, or Firm* — Buchanan Ingersoll & Rooney PC

(57) ABSTRACT

A gas turbine exhaust strut installed in an exhaust case of a gas turbine is disclosed which includes a trailing portion configured with an inner surface for mounting to an inner annular member of the exhaust case and an outer surface for mounting to an outer annular member of the exhaust case, a block attached to the trailing portion, an angled piece attached to the block and configured with a surface on a pressure side of the strut angled with respect to a surface of the trailing portion on the pressure side of the strut, and a transition piece attached to the block and configured with a surface on the pressure side of the strut for smoothing the transition between the height of the block on the pressure side of the strut and the height of the trailing portion on the pressure side of the strut. A method of refurbishing an exhaust strut installed in an exhaust case of gas turbine while retaining at least a portion of the strut in the exhaust case is also disclosed. An exemplary method includes removing a leading edge portion from a trailing portion of the strut, and attaching a replacement leading edge portion to the trailing portion of the strut.

18 Claims, 2 Drawing Sheets

GAS TURBINE EXHAUST STRUT REFURBISHMENT

FIELD

Figure 1A:
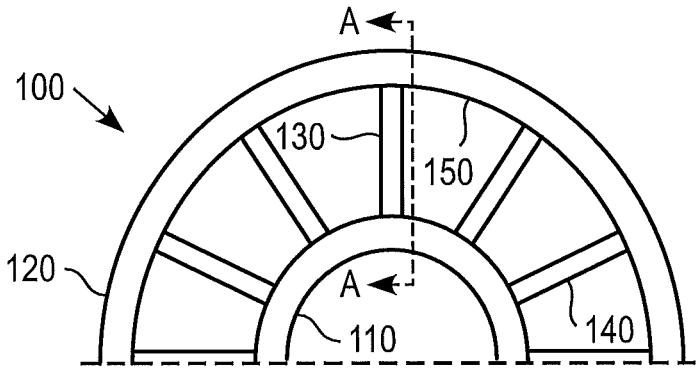

The disclosure relates to the structure of a refurbished gas turbine exhaust strut. The disclosure also relates to a method for refurbishing a gas turbine exhaust strut.

BACKGROUND

Working medium gases discharged from a gas turbine of a turbomachine can have a residual velocity component perpendicular to the turbine axis. Reducing this perpendicular velocity component from the exhaust flow may be desirable to impact operation of the machine. In this regard, gas turbines can include an exhaust case having plural struts, the profile and orientation of which can be configured to reduce the perpendicular velocity component from the exhaust flow in an effort to deswirl the exhaust flow.

It is known to modify a gas turbine machine by replacing the compressor with a higher-flow compressor. However, characteristics of the working medium gases discharged from the gas turbine can change as a result of such a modification whereby the geometry of the existing exhaust case can become less effective in deswirling the exhaust flow. Previously, it was known to replace the entire exhaust case, including the plural struts, with an exhaust case configured for the modified turbine. However, replacing the entire exhaust case can be costly and/or time-consuming.

SUMMARY

A gas turbine exhaust strut installed in an exhaust case of a gas turbine is disclosed which includes a trailing portion configured with an inner surface for mounting to an inner annular member of the exhaust case and an outer surface for mounting to an outer annular member of the exhaust case, a block attached to the trailing portion, an angled piece attached to the block and configured with a surface on a pressure side of the strut angled with respect to a surface of the trailing portion on the pressure side of the strut, and a transition piece attached to the block and configured with a surface on the pressure side of the strut for smoothing the transition between a height of the block on the pressure side of the strut and a height of the trailing portion on the pressure side of the strut.

A gas turbine is disclosed which includes an exhaust case having an inner member and an outer member, and plural struts spanning a flow path formed by the inner member and the outer member. At least one of the struts including a trailing portion, a block attached to the trailing portion, an angled piece attached to the block, and a transition piece attached to the block.

Also disclosed is a method of refurbishing an exhaust strut installed in an exhaust case of gas turbine while retaining at least a portion of the strut in the exhaust case including removing a leading edge portion from a trailing portion of the strut and attaching a replacement leading edge portion to the trailing portion of the strut.

BRIEF DESCRIPTION OF THE DRAWING FIGURES

Figure 1B:
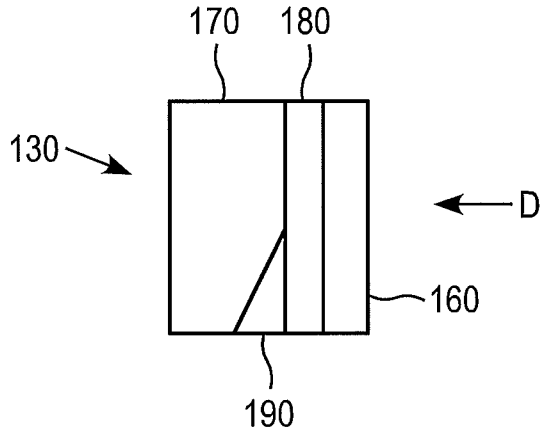
Figure 2A:
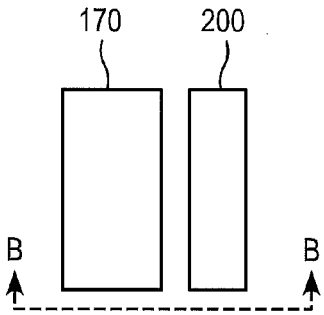
Figure 2B:
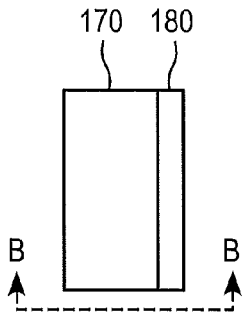
Figure 2C:
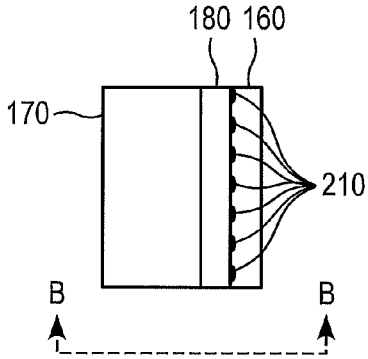
Figure 2D:
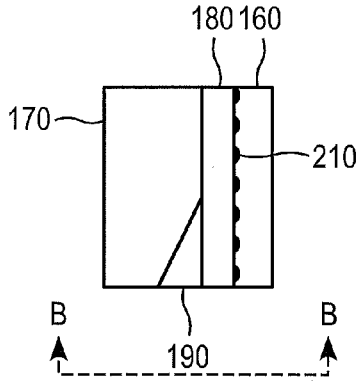
Figure 3A:
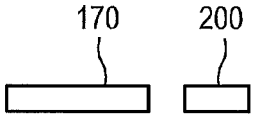
Figure 3B:
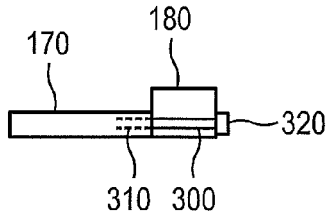
Figure 3C:
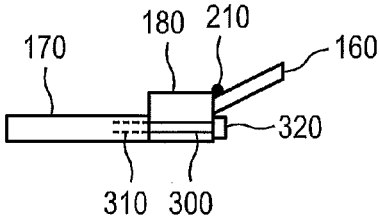
Figure 3D:
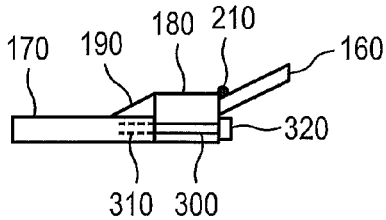

Other objects and advantages of the present invention will be apparent to those skilled in the art from reading the following detailed description of exemplary embodiments in conjunction with the drawings, wherein like elements are represented by like reference numerals, and wherein:

FIG. 1(*a*) illustrates an end view of the top half of an exhaust case according to an exemplary embodiment;

FIG. 1(*b*) illustrates an exemplary strut as seen in the view along line A-A of FIG. 1;

FIGS. 2(*a*)-2(*d*) illustrate an exemplary method of refurbishing; and

FIGS. 3(*a*)-3(*d*) illustrate views along the respective lines B-B of FIGS. 2(*a*)-2(*d*).

DETAILED DESCRIPTION

FIG. 1(*a*) illustrates an exemplary gas turbine exhaust strut 130 installed in an exhaust case 100 of a gas turbine. Referring to FIG. 1(*b*), an exemplary strut includes a trailing portion 170, a block 180 attached to the trailing portion, an angled piece 160 attached to the block 180, and a transition piece 190 attached to the block 180. In the FIG. 1(*a*) example, the exhaust case 100 includes an inner member 110 (e.g., a smaller annular member), an outer member 120 (e.g., a larger annular member), and plural struts 130. An inner wall 140 of the inner member 110 and an outer wall 150 of the outer member 120 form an annular flow path for exhaust gases.

Referring to FIG. 1(*b*), the exhaust gases entering the exhaust case 100 flow generally in the direction of the arrow D, although with a perpendicular velocity component which causes the exhaust flow to be swirled. The struts 130 extend from the inner wall 140 to the outer wall 150 to connect the inner member 110 and the outer member 120, and the struts 130 can span the annular flow path. The struts 130 can be circumferentially spaced apart and can extend generally radially and axially with respect to a longitudinal axis of the turbine. The struts 130 can be positioned so that the exhaust flow path is first influenced by the angled piece 160 of the strut 130, and then by the trailing portion 170 of the strut 130. The strut can also include a block 180 and a transition piece 190. The surfaces of the trailing portion 170, the block 180, the angled piece 160, and the transition piece 190 on the pressure side of the strut, and their orientation within the exhaust case 100, can be configured to reduce the perpendicular velocity component from the exhaust flow in an effort to deswirl the exhaust flow.

FIGS. 2(*a*)-2(*d*) show an exemplary method for refurbishing a gas turbine strut. As shown in FIG. 2(*a*), the exemplary method includes removing the leading edge portion 200 from a trailing portion 170 of the strut. For example, the original leading edge portion 200 can be cut off from the strut 130, leaving the trailing portion 170 installed in the exhaust case 100, as illustrated in FIG. 2(*a*). An outer surface of the trailing portion 170 remains mounted to the outer member 120, while an inner surface of the trailing portion 170 remains mounted to the inner member 110. Of course, the original leading edge portion 200 can also be removed by other methods, for example, by grinding, or laser removal, or the like.

The method can also include attaching a replacement leading edge portion to the trailing portion of the strut as shown, for example, in FIG. 2(*b*). In the FIG. 2(*b*) example, a block 180 can be attached, (e.g., bolted, or welded, or the like) to the trailing portion 170 along at least a portion of the edge formed by removal of the original leading edge portion 200, as shown in FIG. 2(*b*).

An angled piece 160 can be attached to the side of the block 180 opposite the trailing portion 170, as illustrated in FIG. 2(*c*). A stitch weld 210 having alternating welded and unwelded areas can, for example, be used to attach the angled piece 160 to the block 180.

As illustrated in FIG. 2(*d*), a transition piece 190, for example, a wedge-shaped piece can then be attached (e.g., welded) to the side of the block 180 that is tightened to the trailing portion 170.

FIG. 3(*a*) illustrates an end view of the exemplary removal of the leading edge portion 200 from a trailing portion 170 of the strut.

As shown in FIG. 3(*b*), prior to bolting the block 180 to the trailing portion 170, the block 180 can be fixtured (e.g., clamped) to the trailing portion 170 and preexisting holes 300 can be used as a guide to drill and tap corresponding threaded holes 310 into the trailing portion 170. After the bolts 320 are placed through the holes 300 and 310, they can be tightened to fix the block 180 to the trailing portion 170. The heads of the bolts 320 can then be welded to the block 180. As also illustrated in FIG. 3(*b*), the block 180 can be thicker than trailing portion 170, and positioned such that it protrudes relative to the pressure side of the trailing portion 170.

As shown in FIG. 3(*c*), the angled piece 160 can be welded to the block 180 in an area adjacent to the heads of the bolts 320. As also illustrated in FIG. 3(*c*), the angled piece 160 can be designed to alter the entry angle on the pressure side of the refurbished strut. For example, the angled piece 160 can be configured so that the surface of the angled piece 160 on the pressure side of the strut is angled with respect to the surface of the trailing portion 170 on the pressure side of the strut, and so that the entry angle of the strut matches the exit angle of the exhaust gas flow of the modified gas turbine.

As illustrated in FIG. 3(*d*), the transition piece 190 can be wedge-shaped and can be configured and placed to impact the aerodynamic functionality of the strut, for example, by smoothing the transition between the height of the block 180 on the pressure side of the strut and the height of the trailing portion 170 on the pressure side of the strut.

When the characteristics of the exhaust flow change, such as when the compressor of the turbine is changed, the struts 130 can be refurbished to accommodate a modified exhaust flow. The refurbishing can be performed while the struts 130 remain attached to the exhaust casing 100 of the gas turbine.

In a further aspect of the exemplary method, the angled piece 160, block 180, transition piece 190, and/or bolts 320 can be formed from STOX5 (10 CrAl 7). It has been discovered that heat treatment is not necessary after welding STOX5. Thus, in an exemplary method, welding of the components formed from STOX5 can be performed in situ without heat treatment.

It will be appreciated by those skilled in the art that the present invention can be embodied in other specific forms without departing from the spirit or essential characteristics thereof. The presently disclosed exemplary embodiments are therefore considered in all respects to be illustrative and not restricted.

The invention claimed is:

1. A gas turbine exhaust strut for installation in an exhaust case of a gas turbine, comprising:

a trailing portion configured with an inner surface for mounting to an inner annular member of the exhaust case and an outer surface for mounting to an outer annular member of the exhaust case;

a block attached to the trailing portion;

an angled piece attached to the block and configured with a surface on a pressure side of the strut angled with respect to a surface of the trailing portion on the pressure side of the strut; and a transition piece attached to the block and configured with a surface on the pressure side of the strut for smoothing the transition between a height of the block on the pressure side of the strut and a height of the trailing portion on the pressure side of the strut.

2. The gas turbine exhaust strut according to claim 1, wherein the block is bolted to the trailing portion.

3. The gas turbine exhaust strut according to claim 1, wherein the angled piece is welded to the block.

4. The gas turbine exhaust strut according to claim 1, wherein the transition piece is a wedge-shaped piece welded to the block.

5. A gas turbine comprising:

an exhaust case having an inner member and an outer member; and plural struts spanning a flow path formed by the inner member and the outer member, at least one of the struts including a trailing portion, a block attached to the trailing portion, an angled piece attached to the block, and a transition piece attached to the block.

6. The gas turbine according to claim 5, wherein the block is bolted to the trailing portion.

7. The gas turbine according to claim 5, wherein the angled piece is welded to the block.

8. The gas turbine according to claim 5, wherein the transition piece is a wedge-shaped piece welded to the block.

9. A method of refurbishing an exhaust strut installed in an exhaust case of gas turbine while retaining at least a portion of the strut in the exhaust case, the method comprising:

removing a leading edge portion from a trailing portion of the strut; and attaching a replacement leading edge portion to the trailing portion of the strut, wherein the attaching of the replacement leading edge portion comprises attaching a block to the trailing portion of the strut, attaching an angled piece to the block, and attaching a wedge-shaped piece to the block.

10. The method of claim 9, wherein during the removing of the leading edge portion, the trailing portion of the strut remains installed in the exhaust case.

11. The method of claim 9, wherein during the attaching of the replacement leading edge portion, the trailing portion of the strut remains installed in the exhaust case.

12. The method of claim 9, wherein the removing of the leading edge portion comprises:

cutting the leading edge portion from the trailing portion of the strut.

13. The method of claim 9, wherein the block is bolted to the trailing portion of the strut.

14. The method of claim 9, wherein the angled piece is welded to the block.

15. The method of claim 14, wherein the block and the angled piece are both formed from STOX5, and wherein the welding is performed without heat treatment.

16. The method of claim 9, wherein the wedge-shaped piece is welded to the block.

17. The method of claim 16, wherein the block and the wedge-shaped piece are both formed from STOX5, and wherein the welding is performed without heat treatment.

18. The method according to claim 9, wherein all of the exhaust struts installed in an exhaust case of a gas turbine are refurbished while retaining at least a portion of each strut in the exhaust case.

* * * * *